United States Patent [19]

von Hein et al.

[11] Patent Number: 4,600,186

[45] Date of Patent: Jul. 15, 1986

[54] METHOD AND APPARATUS FOR REDUCING THE IMPACT SPEED OF A PRINTED PRODUCT WHICH IS DELIVERED TO A FLY POCKET OF A FLY DELIVERY WHEEL IN A ROTARY PRINTING PRESS

[75] Inventors: Eduard von Hein, Bern; Ertavi Tibor, Worb, both of Switzerland

[73] Assignee: Maschinenfabrik Wifag, Switzerland

[21] Appl. No.: 580,793

[22] Filed: Feb. 16, 1984

[30] Foreign Application Priority Data

Feb. 21, 1983 [SE] Sweden ..... 8300940

[51] Int. Cl.[4] ..... B65H 29/68

[52] U.S. Cl. ..... 271/182; 271/187; 271/315

[58] Field of Search ..... 271/187, 315, 182

[56] References Cited

U.S. PATENT DOCUMENTS

| | | | |
|---|---|---|---|
| 1,949,152 | 2/1934 | Fankboner | 271/315 |
| 3,421,757 | 1/1969 | Boisseau | 271/182 |
| 3,685,823 | 8/1972 | Chambon | 271/182 |

FOREIGN PATENT DOCUMENTS

| | | | |
|---|---|---|---|
| 949871 | 2/1964 | United Kingdom | 271/187 |

*Primary Examiner*—Richard A. Schacher
*Attorney, Agent, or Firm*—McGlew and Tuttle

[57] ABSTRACT

The impact speed of a printed product which is delivered at a rapid rate into a pocket of a rotatable flywheel is reduced by engaging the printed product as it is propelled into the flywheel pocket adjacent its trailing edge. The invention includes a fly delivery wheel which may comprise a plurality of individual flywheel elements each having a plurality of flywheel pockets distributed around its circumference. The flywheel pockets open radially and as the openings of each pocket are moved around during the rotation of the flywheel the printed product is delivered into the opening and it moves at high impact speed into the pocket space. A cam is rotatably mounted adjacent the flywheel and adjacent a ring which is carried on a rotatable shaft and the printed products are delivered between the rotatable cam plate and the ring and into the pocket. The cam plate advantageously includes one or more cams having tips with elastic portions which move during rotation of the cam into close contact with the rings. The cam plates are advantageously rotated in an opposite direction to the flywheel and the cams engage the printed products with the rings and reduce the impact of the products into the flywheel receiving pockets.

4 Claims, 2 Drawing Figures

METHOD AND APPARATUS FOR REDUCING THE IMPACT SPEED OF A PRINTED PRODUCT WHICH IS DELIVERED TO A FLY POCKET OF A FLY DELIVERY WHEEL IN A ROTARY PRINTING PRESS

FIELD AND BACKGROUND OF THE INVENTION

The invention relates to printing devices and in particular to a new and useful apparatus and method of reducing the impact speed of printed products at the base of a fly delivery wheel in rotary printing presses.

As is known, the printed products or copies sequentially delivered by the folder of a rotary printing press must be slowed down to a speed corresponding to the sheet-by-sheet stream to be formed, which is basically obtained by means of a fly delivery wheel rotating in timed sequence with the folder.

The printed copies leaving the folder at the speed of the press butt against the base of the slower running delivery wheel are thereby braked to the circumferential speed of the base of the flies. Experience has shown that the impact speed must not exceed a certain value if damages to the printed products are to be avoided. With the outputs wanted today, however. this value is by far exceeded. Consequently, devices have been provided to reliably ensure a speed reduction to the desired value.

All prior art devices of this kind provide a braking of the printed products before they enter the delivery wheel. Now, since the difference between the speed of the press and the permissible impact speed is too large, the time needed by the braked printed products to present their leading edges at the fly base is relatively long. This no longer ensures, for example, that the devices provided for positively withdrawing products from the delivery wheel will take them off in an exact position.

SUMMARY OF THE INVENTION

The invention is directed to a method permitting reduction of the impact speed of printed products fed into a fly delivery wheel at the speed of the press.

Accordingly it is an object of the invention to provide an improved method of reducing the impact speed of a printed product as it is delivered into a pocket of a flywheel and which comprises contacting a portion of the product for a brief period of time as it is moved into the flywheel pocket.

A further object of the invention is to provide a device for reducing the impact speed of a printed product which is delivered into the pockets of a rotatable flywheel of a printing press and which includes a rotatable ring arranged adjacent the periphery of the flywheel and a cam which is positionable to rotate so that cam portions move in close proximity to the ring during its rotation and including means for driving the cam plate so it rotates in an opposite direction to the flywheel and engages a printed product against the ring as the product enters into the pocket of the flywheel.

A further object of the invention is to provide a device for reducing the impact speed of printed products which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

GENERAL DESCRIPTION OF THE PREFERRED EMBODIMENT

Figure 1:
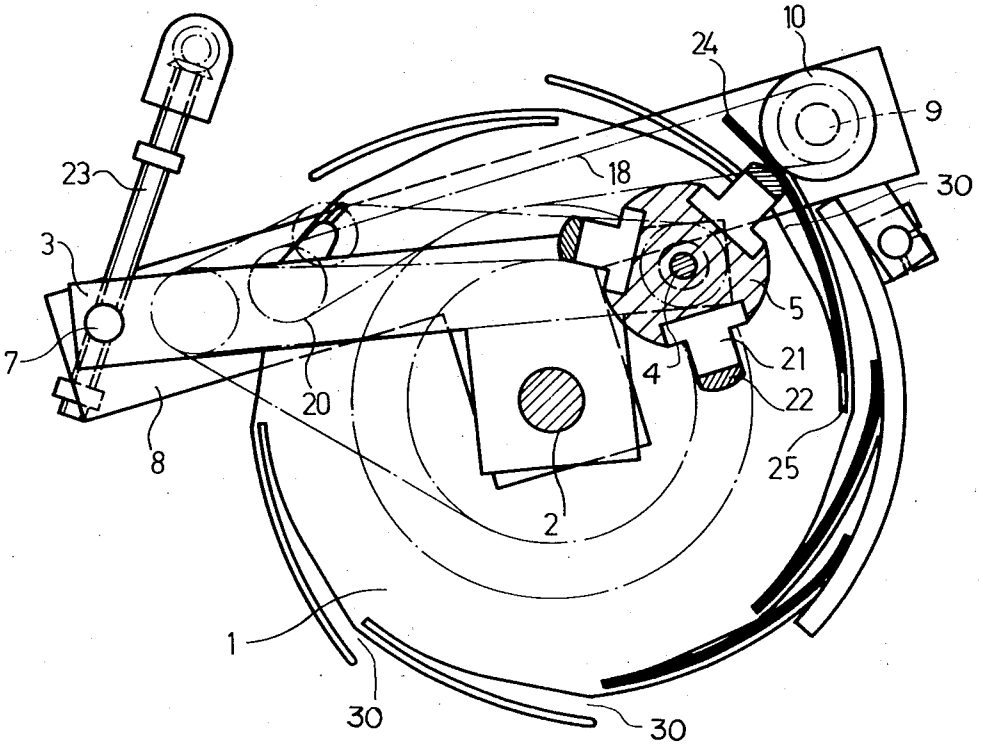
FIG. 1 is a cross-sectional view of a delivery wheel.
Figure 2:
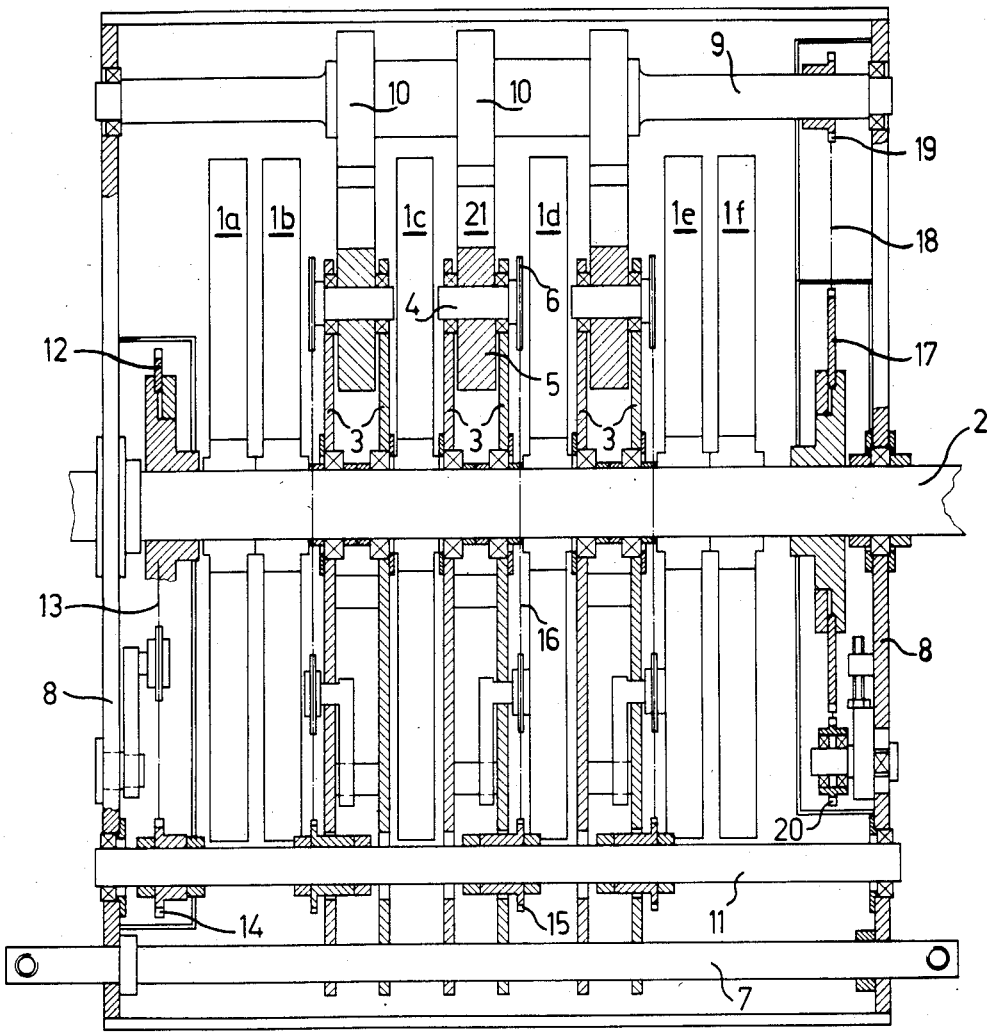
FIG. 2 longitudinal sectional view of the delivery wheel shown in FIG. 1.

Referring to the drawings in particular the invention embodied therein comprises a device for reducing the impact speed of printed products 24 as they are delivered into pockets 30 which are arranged in spaced circumferential location around the periphery of the fly delivery wheel 1 of a printing press. In accordance with the method of the invention the impact is reduced by engaging the printed product temporarily as it is delivered into each pocket 30 in succession as the flywheel 1 is rotated. The apparatus for carrying out the method includes a rotatable flywheel 1 which has a plurality of fly pockets 30 distributed around its periphery each of which has a printed product receiving opening and through each of which a printed card 24 is directed as the flywheel is rotated. The rotatable ring 10 is mounted alongside the flywheel 1 and a rotatable cam plate 5 is rotatably mounted adjacent the ring and has a cam 21 which is moved around with the cam plate 5 during the rotation of the cam plate into close proximity with the rotatable ring and so as engage a printed product 24 which is fed therebetween on its way to the adjacent slide pocket 30 and to brake it as it moves into the associated pocket.

The delivery wheel 1 comprises a plurality of discs, for example six discs 1*a* to 1*f*, which are all firmly connected to a wheel shaft 2 driven from the press. A double arm lever 3 is mounted for pivoting about wheel shaft 2 between the adjacent internal discs 1*b*/1*c*/1*c*/1*d*/1*d*/1*e*. At one side of each arm 3, a cam shaft 4 is mounted for rotation to which a cam plate 5 and a sprocket wheel 6 are non-rotatably secured. The other side of arm 3 is engaged on a setting shaft 7 which is pivoted to a frame 8 surrounding delivery wheel 1. Frame 8 is mounted for pivoting on wheel shaft 2 and carries on its side facing cam plate 5 a shaft 9 which is mounted for rotation and provided with fixed rings 10 cooperating with cam plates 5. On the opposite side of frame 8, a countershaft 11 is mounted for rotation which is driven by means of a first drive wheel 12 and a chain 13 and a wheel 14. On countershaft 11, each cam plate 5 is associated with a sprocket wheel 15 by which sprocket wheel 6, and thus cam plate 5, is driven through a chain 16. All the sprocket wheels 14 and 15 are connected to countershaft 11 in a known manner permitting adjustment.

Through a chain 18 and a sprocket wheel 19 fixed to shaft 9, a second drive wheel 17 connected to wheel shaft 2, drives shaft 9 and thus rings 10 in a direction opposite to cam plates 5, which is effected by suitably training a chain about a deflection wheel 20 which is mounted opposite to shaft 9.

Instead of chains, other nonslip transmission elements may be employed, such as cog belts or gears.

Cams 21 of cam plates 5 are lined with a very elastic material 22 and so dimensioned that with an unchangeable spacing of the axes of cam shaft 4 and shaft 9, printed products of any thickness can be seized and braked without suffering damage.

Setting shaft 7 is connected to a setting mechanism 23 known per se which is actuable manually, mechanically, directly. or remotely. By pivoting the mechanism clockwise, cam plates 5 are automatically displaced counterclockwise relative to delivery wheel 1 and by pivoting it counterclockwise, the cam plates are displaced clockwise. In this way, the mechanism can be so adjusted to various lengths of copies 24 that shortly before the leading edge ofthe copy 24 reaches the base 25 of the delivery fly, the trailing end of the copy 24 is seized by a cam 21 in cooperation with the associated ring 10, and braked.

While a specific embodiment of the invention has been shown and described in detail to illustrate the application of the principles of the invention, it will be understood that the invention may be embodied otherwise without departing from such principles.

What is claimed is:

1. A device for reducing the impact speed of a printed product as it moves into a fly pocket of a rotating delivery flywheel, comprising a rotatable flywheel having a plurality of fly pockets distributed around its periphery, each pocket having a printed pocket receiving opening into each of which a printed product is directed as the flywheel is rotated, a rotatable ring rotatably mounted alongside said flywheel, and a rotatable cam plate rotatably mounted adjacent said ring and having a cam movable therearound which moves during rotation into close proximity with said ring to engage a printed product fed between said ring and said cam as it moves into the adjacent fly pocket and to brake it whereby to reduce the impact speed thereof, a support frame, said delivery flywheel having a plurality of flywheel portions each having circumferentially spaced fly pockets, the fly pockets of adjacent wheels being aligned laterally, a lever member pivotally mounted adjacent one end between adjacent flywheel portions and having an opposite end on which said cam plate is rotatably mounted, a flywheel delivery shaft rotatable in said frame and carrying said flywheel portion for rotation therewith, a ring shaft carrying said rings and being rotatable on said frame, and drive means connected between said rotatable delivery flywheel shaft and said cam plate to rotate said plate in an opposite direction to said flywheel portions.

2. A device according to claim 1, wherein said cams each include an outer elastic portion which is bearable against the product.

3. A device according to claim 1, wherein said drive means includes a chain, said frame having a deflection sprocket rotatably mounted thereon over which said chain engages and being connected to the drive shaft of said delivery flywheels and the shaft for said rings.

4. A device according to claim 1, including setting means connected to said lever for shifting said lever with said cam plate.

* * * * *